United States Patent [19]

Tokuoka et al.

[11] 4,097,313

[45] June 27, 1978

[54] METHOD OF RECOVERY OF FERROMAGNETIC METAL OR ALLOY PARTICLES BY USING A MAGNETIC DRUM

[75] Inventors: Yasumichi Tokuoka; Kazumasa Fukuda; Akihiko Hosaka, all of Tokyo, Japan

[73] Assignee: TDK Electronics Co., Ltd., Tokyo, Japan

[21] Appl. No.: 744,116

[22] Filed: Nov. 22, 1976

[30] Foreign Application Priority Data

Dec. 8, 1975 Japan ..... 50-1416160

[51] Int. Cl.[2] ..... H01F 1/02

[52] U.S. Cl. ..... 148/105; 75/0.5 AA; 148/108

[58] Field of Search ..... 148/105, 108; 75/0.5 AA; 252/62, 55

[56] References Cited

U.S. PATENT DOCUMENTS

| | | | |
|---|---|---|---|
| 3,206,338 | 9/1965 | Miller et al. | 75/105 |
| 3,607,218 | 9/1971 | Akashi et al. | 75/0.5 AA |
| 3,684,484 | 8/1972 | Marchese et al. | 75/0.5 A |
| 3,755,008 | 8/1973 | Ehrreich et al. | 148/105 |
| 3,843,349 | 10/1974 | Ehrreich et al. | 75/0.5 AA |

*Primary Examiner*—Walter R. Satterfield

*Attorney, Agent, or Firm*—Oblon, Fisher, Spivak, McClelland & Maier

[57] ABSTRACT

Ferromagnetic metal or alloy particles are prepared by reducing ferromagnetic metal ions in the solution with a reducing agent to obtain a slurry of ferromagnetic metal or alloy particles and separating the particles by attracting the particles on a magnetic drum which is rotated under contacting with the slurry, and washing the particles and separating the particles from the magnetic drum.

5 Claims, 5 Drawing Figures

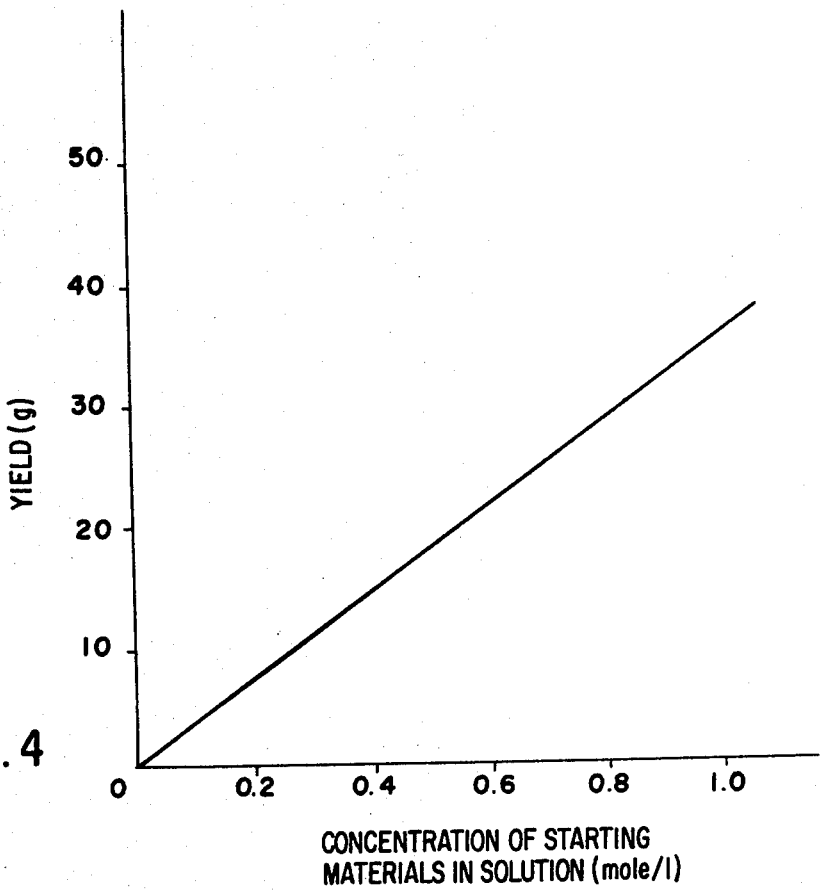
FIG. 4
FIG. 5
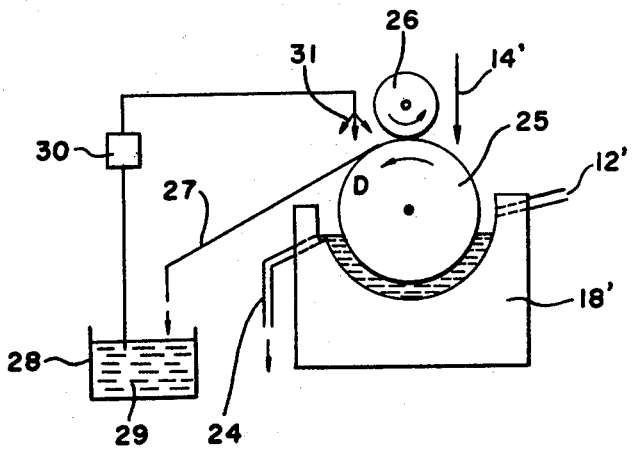

METHOD OF RECOVERY OF FERROMAGNETIC METAL OR ALLOY PARTICLES BY USING A MAGNETIC DRUM

BACKGROUND OF THE INVENTION

The present invention relates to a method of recovery of ferromagnetic metal or alloy particles.

The ferromagnetic metal or alloy particles can be precipitated under a reduction by reacting a boron hydride with ferromagnetic metal ions (iron, cobalt, nickel) in the solution.

It has been known that when the reaction is carried out in a magnetic field, acicular particles extended to the direction of the magnetic field can be obtained.

The resulting acicular particles have high saturated magnetic moment and high coercive force and are useful as the high density recording medium. However, the mass production of the acicular particles has been hardly attained. The process for preparing ferromagnetic metal or alloy particles without said difficulty has been proposed.

However, it has been difficult to separate the ferromagnetic metal or alloy particles, continuously.

SUMMARY OF THE INVENTION

It is an object of the present invention to provide a method of recovery of ferromagnetic metal or alloy particles from a slurry speedily. It is another object of the present invention to provide a method of recovery of ferromagnetic metal or alloy particles which maintain excellent magnetic characteristics. These object of the invention have been attained by reducing ferromagnetic metal ions in the solution with a reducing agent to obtain a slurry of ferromagnetic metal or alloy particles and separating the ferromagnetic metal or alloy particles by attracting the particles on a magnet drum which is rotated under contacting with the slurry, and washing the particles and separating the particles from the magnet drum.

BRIEF DESCRIPTION OF THE DRAWINGS

FIG. 4 is a graph which shows the relationship of the yield versus the concentration of starting materials in the solution; and FIG. 5 is a schematic view of a recovery system for recovering ferromagnetic metal or alloy particles according to the invention.

DETAILED DESCRIPTION OF THE PREFERRED EMBODIMENTS

The inventors have previously invented and proposed the process for effectively preparing ferromagnetic metal or alloy particles by the above-mentioned method.

Figure 1:
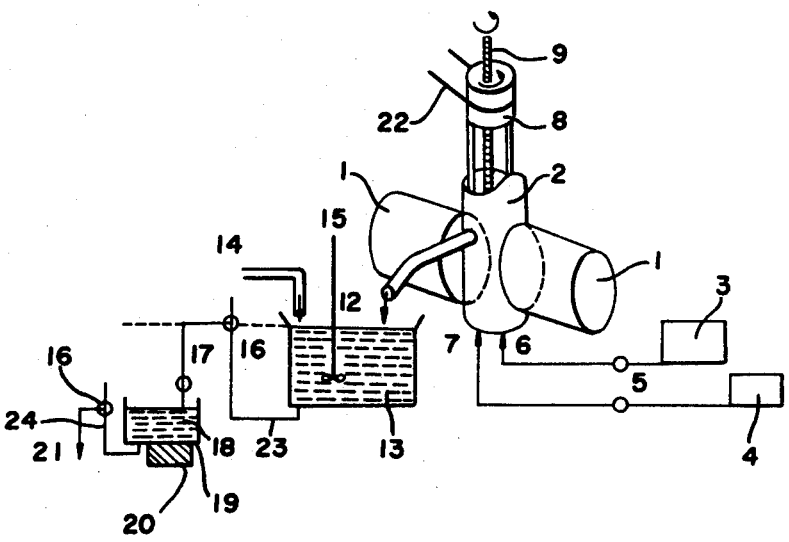
FIG. 1 is a schematic view of a system for preparing ferromagnetic metal or alloy particles.
Figure 2:
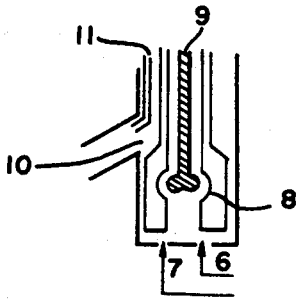
FIG. 2 is a sectional view of the reactor of FIG. 1.
Figure 3:
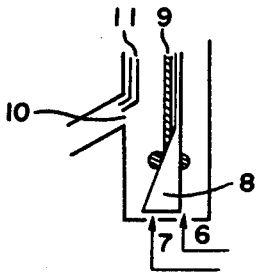
FIG. 3 is a sectional view of the reactor of FIG. 1 wherein the plate is turned.

Referring to FIGS. 1 to 3, the process will be illustrated. In FIG. 1, two columnar permanent magnets 1 are closely fixed on the outer surface of a reactor 2 made of non-magnetic material. The solutions of the starting materials are respectively fed from a tank 3 containing a solution of a reducing agent such as sodium boron hydride and a tank 4 containing a solution of a ferromagnetic metal salt such as ferrous sulfate, cobalt chloride through each inlet 6 or 7 to the reactor 2 by a pump 5.

As shown in FIG. 2, the reactor 2 is equipped with a stirrer 9 which is rotated by a motor (not shown). In the reactor, the metal salt is reduced to form ferromagnetic metal or alloy particles. The slurry of the particles is moved along a rotary particle conveying plate 8 to the upper part of the reactor 2.

The rotary particle conveying plate 8 has a structure for moving the slurry to the upper part by the rotation. The upper end of the plate 8 is connected to a pulley 8' which is concentrically fitted with the stirrer 9 and the pulley 8' is rotated by a belt 22 which is driven by the other motor.

The slurry moved to the upper part of the reactor 2 is passed through an outlet 10 and a pipe 12 to a washing tank 13 with the assistance of the flow discharged from a pipe 11 for particle conveying flow which is disposed near the outlet 10.

The washing tank 13 is equipped with a stirrer 15 and the ferromagnetic particles in the slurry are washed with a water fed through a pipe 14 for washing water, while stirring by the stirrer.

The washed ferromagnetic particles are fed together with the solution through a pipe 23, a valve 16, a valve 17 to a recovery tank (reclaimer) 18 for ferromagnetic particles. The level of the valve 16 in same with the level of the solution in the washing tank 13.

The level of the valve 16 is same with the level of the solution in the washing tank 13. Accordingly, the solution is automatically flowed out when the level of the solution become higher than the level of the valve in the open state.

A magnet for recovery 20 is disposed at the outer surface of the bottom of the recovery tank 18 whereby the ferromagnetic particles 19 are remained at the bottom of the recovery tank 18.

The solution is discharged through a pipe 24 and the valve 16 whose level is same with the level of the solution in the recovery tank 18. The operation is stopped at desired time and all contents in the recovery tank 18 are discharged to recover the ferromagnetic particles 19.

It is possible to dispose a magnetic drum connected with a belt, in the recovery tank 18 instead of using magnet for recovery, whereby the ferromagnetic particles can be deposited on the belt and continuously recovered.

In the process of the invention, the ferromagnetic metal ions can be $Fe^{2+}$, $Fe^{3+}$, $Co^{2+}$, $Ni^{2+}$ and a mixture thereof and the ions are in the form of the water soluble salts such as sulfate, nitrate, chloride etc. The concentration of the ferromagentic metal salt is usually in a range of 0.1 to 2 mole/liter and especially about 1 mole/liter.

Suitable reducing agents include sodium or potassium boron hydride and the concentration of the reducing agent is usually in a range of 0.1 to 2 mole/liter especially about 1 mole/liter.

When a mixture of ferrous sulfate and cobalt chloride at a ratio of 1:9 (cobalt chloride/ferrous sulfate) is used as the metal salt and sodium boron hydride is used as the reducing agent and the reactor is disposed in the field of 1000 Oe, where each solution of equimole is fed from the tanks at rates of about 0.25 cc/sec., the yields per 1 liter of the solution are as shown in the graph of FIG. 4.

The ferromagnetic particles are recovered after the reaction and are washed with ethanol and acetone and was dried at 200° C in hydrogen gas atmosphere.

The typical characteristics are shown in Table 1.

Table 1:

| Sample no. | Temperature for drying (° C) | Saturation magnetization (emu/g) | Coercive force (Hc) |
|---|---|---|---|
| 1 | 200° C | 150 emu/g | 560 Oe |
| 2 | room temperature | 134 emu/g | 748 Oe |

The ferromagnetic particles obtained by the above-mentioned process, are easily corroded with water because they are prepared by the reduction in the solution, moreover, the corrosion of the ferromagnetic particles with water is remarkably caused in the step of removing unreacted ions and by-product salts after the reaction, whereby the deterioration of the magnetic characteristics of the ferromagnetic particles may be progressed.

FIG. 5 is a schematic view of an improved recovery apparatus to overcome the troubles.

The ferromagnetic particles fed together with the solution from the reactor (FIG. 1) into the recovery tank 18', are attracted on a magnetic drum 25 to be separated from the solution.

The ferromagnetic particles are washed with water shown by the arrow line 14' and then water in the particles is squeezed by a rubber roller 26 which is rotated under pressing on the magnet drum 25. The ferromagnetic particles are scraped off at D point of the magnet drum 25 by a scraper 27 contacting with the magnetic drum. An organic medium 29 in the organic medium tank 28 is drawn up by a pump 30 to make a shower 31 and the scraped particles are flowed into the organic medium tank 28 by the shower, and are stored in the tank.

The ferromagnetic particles prepared by the reduction in the solution are continuously separated from the solution of reaction residue and the impurities, and the particles are selectively recovered and transferred into the organic medium.

The solution of reaction residue is discharged from an output 24 after separating the particles.

The organic medium can be alcohols such as methanol, ethanol, acetone, methylethyl ketone or mixtures thereof.

The ferromagnetic particles can be stored in these organic medium in stable for a long time. Accordingly, the ferromagnetic particles which are continuously prepared can be stored in an organic medium tank 28. In the above example, the embodiment using only one recovery apparatus has been illustrated. It is possible to connect a plurality of the recovery apparatuses in series. In the latter case, the ferromagnetic particles are fed with water for washing by the shower 31 into the tank 28. In the next recovery apparatus, the ferromagnetic particles are combined with the organic medium.

The third recovery apparatus can be connected in series wherein in the first step, the water for washing is applied and in the second step, the aqueous organic medium is applied and in the third step, nonaqueous organic medium is applied whereby the ferromgnetic particles can be stored for a long time.

The oxidation of the ferromagnetic particles with water can be effectively prevented, and the ferromagnetic particles having high saturated magnetic moment can be continuously obtained.

The inventors have further studied and found that the ferromagnetic particles having higher saturated magnetic moment can be obtained by coating a water-repellent lubricant on the surface of the magnet drum 25.

The lubricant can be conventional lubricant such as grease, vaseline, wax, paraffin etc.. It is possible to coat the surface of the magnet drum with a fluoro resin; such as polytetrafluoroethylene.

EXAMPLES

An aqueous solution of 1 mole of sodium boron hydride and an aqueous solution of 0.9 mole of ferrous sulfate and 0.1 mole of cobalt sulfate were respectively fed into a reactor at a rate of about 30 cc/min.. The ferromagnetic particles which were precipitated at a rate of 1 to 1.5 g/min. were continuously recovered by using the above-mentioned apparatus, and were stored.

The magnetic characteristics of the ferromagnetic particles were measured at the time of production and after storing them.

The sample I was prepared without coating a lubricant on the surface of the magnet drum.

The sample II was prepared by coating silicone grease.

The results are shown in Table 2.

The saturated magnetic moment of the conventional ferromagnetic iron oxide particles is lower than 80 emu/g. The samples I and II maintained high saturated magnetic moment for a long time.

Table 2:

| Sample No. | Sample I | | | Sample II | | |
|---|---|---|---|---|---|---|
| Days for storing | 0 | 7 | 14 | 0 | 7 | 14 |
| Saturation magnetization (emu/g) | 115 | 115 | 114 | 141 | 141 | 140 |
| Coercive force (OE) | 1191 | 1193 | 1193 | 1075 | 1079 | 1077 |
| Squareness ratio | 0.56 | 0.56 | 0.56 | 0.56 | 0.56 | 0.56 |

The sample II had higher saturated magnetic moment comprising with that of the sample I. The fact shows that the silicone grease coating is effective for improving it. It is considered that the fact is caused by the following reason.

Since the surface of the magnet drum is coated with the silicone grease as a water-repellent lubricant, the separation of water from the ferromagnetic particles is effectively attained to prevent the oxidation of the ferromagnetic particles with water.

In accordance with the invention, the ferromagnetic particles in the solution can be recovered speedily and the magnetic characteristics of the ferromagnetic particles can be maintained for a long time.

What is claimed is:

1. In a process for preparing ferromagnetic metal or alloy particles which comprises reducing ferromagnetic metal ions in a solution with a reducing agent to obtain a slurry of ferromagnetic metal or alloy particles and separating the said particles from said slurry, the improvement which comprises:

separating said particles from said slurry by attracting said particles on a magnetic drum;

washing said particles;

recovering said particles from said magnetic drum.

2. The process of claim 1 wherein the ferromagnetic metal or alloy particles are precipitated under a magnetic field.

3. The process of claim 1 wherein the ferromagnetic metal or alloy particles are washed with water on the surface of the magnet drum so as to easily separate water.

4. The process of claim 1 wherein the surface of the magnet drum is coated with a water-repellent lubricant.

5. The process of claim 1 wherein two or more magnet drums are arranged in series and the ferromagnetic metal or alloy particles are separated from the aqueous solution on the first magnet drum and then the particles are combined with an organic medium and are separated from the organic medium on the second or following magnet drum.

* * * * *